US011352160B2

(12) United States Patent
Pennington et al.

(10) Patent No.: US 11,352,160 B2
(45) Date of Patent: Jun. 7, 2022

(54) APPARATUS FOR EMPTYING BAGS

(71) Applicant: Tetra Laval Holdings & Finance S.A., Pully (CH)

(72) Inventors: Jack Pennington, Hamilton (NZ); Robert McHugh, Hamilton (NZ); Paul Feist, Hamilton (NZ)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 17/048,025

(22) PCT Filed: Apr. 16, 2019

(86) PCT No.: PCT/EP2019/059838
§ 371 (c)(1),
(2) Date: Oct. 15, 2020

(87) PCT Pub. No.: WO2019/201946
PCT Pub. Date: Oct. 24, 2019

(65) Prior Publication Data

US 2021/0114761 A1 Apr. 22, 2021

(30) Foreign Application Priority Data

Apr. 20, 2018 (EP) ..... 18168519

(51) Int. Cl.
*B65B 69/00* (2006.01)
*B26D 1/03* (2006.01)

(52) U.S. Cl.
CPC ..... *B65B 69/0008* (2013.01); *B26D 1/035* (2013.01); *B65B 69/0033* (2013.01)

(58) Field of Classification Search
CPC . B65B 69/0008; B65B 69/0033; B26D 1/035; B26D 1/015; B26D 1/01; B26D 1/04; B26D 2001/0033; A01F 29/005
See application file for complete search history.

(56) References Cited

U.S. PATENT DOCUMENTS 4,134,508 A 1/1979 Burdett
4,289,438 A 9/1981 Murer
(Continued)

FOREIGN PATENT DOCUMENTS

EP 0 003 724 A1 8/1979
EP 0 198 685 A1 10/1986
(Continued)

OTHER PUBLICATIONS

International Search Report for corresponding Application No. PCT/EP2019/059838, dated Jul. 8, 2019.
(Continued)

*Primary Examiner* — Glenn F Myers
(74) *Attorney, Agent, or Firm* — Renner, Otto, Boisselle & Sklar, LLP

(57) ABSTRACT

An apparatus for emptying bags includes a cutting mechanism, wherein cut bags are separated from the contents therein on a bag support, a bag disposal mechanism including a vacuum unit to deliver the bags to a disposal unit. The cutting mechanism includes first and second cutting devices arranged to cut the bags along at least two cut directions, in relation to a longitudinal direction along which the bags are conveyed from the cutting mechanism, to cut a foldable flap in the material from which the bags are formed so that the flap can fold into openings of the bag support to empty the content through the openings. A related method for emptying bags is also disclosed.

15 Claims, 8 Drawing Sheets

(56) References Cited

U.S. PATENT DOCUMENTS

| | | | | |
|---|---|---|---|---|
| 5,056,980 | A | 10/1991 | Redl | |
| 6,241,097 | B1 * | 6/2001 | Roman | B03B 9/06 209/3 |
| 7,341,416 | B1 * | 3/2008 | Rubtsov | B65B 69/0008 414/412 |
| 8,197,174 | B1 * | 6/2012 | Caron | B65B 69/0033 414/412 |
| 2007/0169438 | A1 | 7/2007 | Brown | |

FOREIGN PATENT DOCUMENTS

| | | | |
|---|---|---|---|
| EP | 0 395 941 | A1 | 11/1990 |
| EP | 0 692 429 | A1 | 1/1996 |
| EP | 1 197 434 | A1 | 4/2002 |
| EP | 2 128 032 | A1 | 12/2009 |
| WO | 2011/057392 | A1 | 5/2011 |

OTHER PUBLICATIONS

Extended European Search Report for corresponding Application No. 19169591.5-1016, dated Jul. 8, 2019.

* cited by examiner

APPARATUS FOR EMPTYING BAGS

TECHNICAL FIELD

The present invention generally relates to the field of materials handling, such as the handling of powder materials to be supplied to various process lines. More particularly, the present invention relates to an apparatus for emptying bags, filled with a material, and a related method for emptying such bags.

BACKGROUND

Various materials handling processes in process lines involve the supply of material from containers such as bags. A continuous supply of material, for example powder materials contained in such bags, will be required at a certain rate to maintain a desired throughput of the process line. The bags may be supplied on conveyors and manipulated for emptying the contents therein for delivery of the material to the next step in the process line. New generation process lines with increased throughput demands for more efficient materials handling processes. Problems with previous solutions for emptying bags containing such materials are thus associated with lacking efficiency, and/or complex procedures for emptying the bags, which are difficult or less viable to implement on a large scale. It is also desirable to reduce the amount of material wasted and to conveniently handle the bags after being emptied. Some manufacturing processes have also strict hygienic requirements. The handling of milk powder for infants is one example of such process line with elevated hygienic requirements. Further problems with previous solutions are thus related to methods of opening the bags that are either sub-optimal with respect to certain hygienic standards, or requiring added sterilization procedures which increase the complexity and costs of the process line.

It would thus be advantageous with an improved apparatus and method for emptying bags, in particular allowing for avoiding at least some of the above-mentioned problems and compromises, including providing for increased efficiency by which the bags are handled and emptied. Additionally, a more hygienic process of emptying the bags would be desired.

SUMMARY

Accordingly, examples of the present invention preferably seek to mitigate, alleviate or eliminate one or more deficiencies, disadvantages or issues in the art, such as the above-identified, singly or in any combination by providing a device according to the appended patent claims.

According to a first aspect an apparatus for emptying bags is provided, comprising a cutting mechanism to cut the bags, and a bag support. The cutting mechanism, in use, receives the bags and conveys bags being cut by the cutting mechanism to the bag support, the cut bags being separated from the contents therein on the bag support, whereby the content is received in a collection unit arranged beneath the bag support. The apparatus comprises a bag disposal mechanism comprising a vacuum unit to retrieve bags emptied on the bag support and to deliver the bags to a disposal unit. The cutting mechanism comprises first and second cutting devices arranged to cut the bags along at least two cut directions, in relation to a longitudinal direction along which the bags are conveyed from the cutting mechanism, to cut a foldable flap in the material from which the bags are formed so that the flap can fold into openings of the bag support to empty the content through the openings.

According to a second aspect a method for emptying bags is provided, comprising receiving the bags in a cutting mechanism to cut the bags, conveying the cut bags to a bag support, separating the bags from the contents therein on the bag support, whereby the content is received in a collection unit arranged beneath the bag support. The method comprises retrieving the emptied bags with a vacuum unit, delivering the bags to a disposal unit, wherein the bags are cut along at least two cut directions, in relation to a longitudinal direction along which the bags are conveyed from the cutting mechanism, to cut a foldable flap in the material from which the bags are formed so that the flap can fold into openings of the bag support to empty the content through the openings.

Further examples of the invention are defined in the dependent claims, wherein features for the first aspect may be implemented for the second aspect, and vice versa.

Some examples of the disclosure provide for an improved method of emptying bags in which a material is stored.

Some examples of the disclosure provide for an improved method of cutting bags to remove the material stored therein.

Some examples of the disclosure provide for a more hygienic process of emptying bags.

Some examples of the disclosure provide for reducing the amount of material wasted when extracting the material from bags.

Some examples of the disclosure provide for facilitated handling of bags being emptied.

Some examples of the disclosure provide for increased flexibility in using both fully automatic and semi-automatic operation of a process for emptying bags.

Some examples of the disclosure provide for increasing the throughput of a process line being supplied with material stored in bags.

Some examples of the disclosure provide for a method of emptying bags which is less complex and requiring less maintenance and resources.

Some examples of the disclosure provide for increasing the quality of the product manufactured in the process line from a material stored in bags.

Some examples of the disclosure provide for increased safety of operation of a method of emptying bags.

Some examples of the disclosure provide for improved repeatability of operation regardless of the type of material supplied in the bags being emptied.

DRAWINGS

These and other aspects, features and advantages of which examples of the invention are capable of will be apparent and elucidated from the following description of examples of the present invention, reference being made to the accompanying drawings, in which.

Figure 5A:
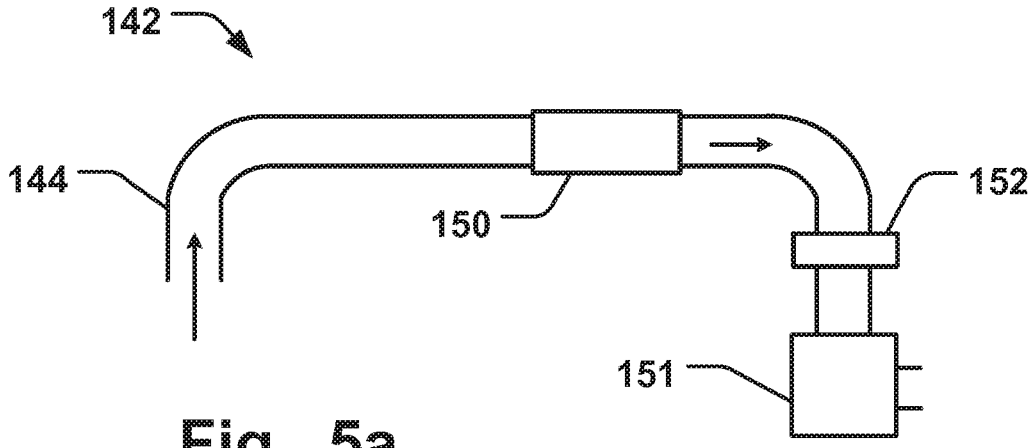
Figure 5B:
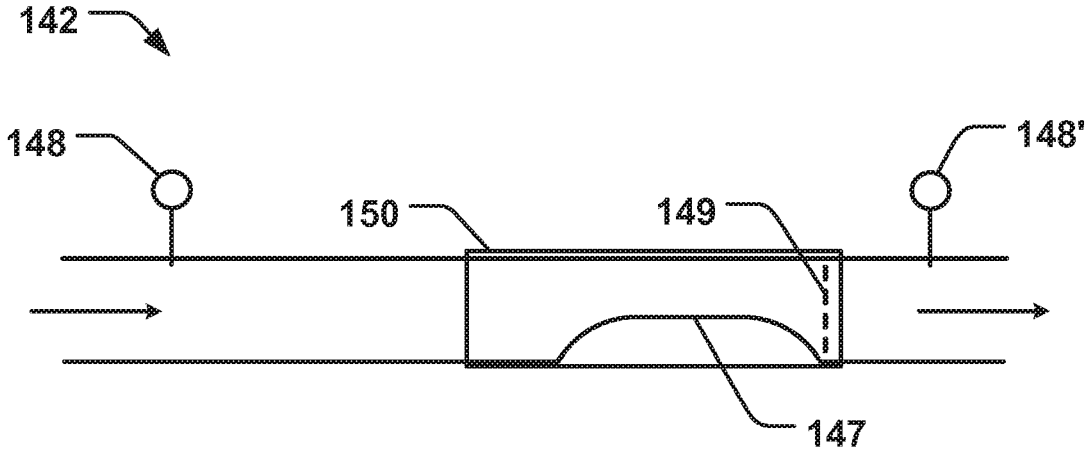
Figure 5C:
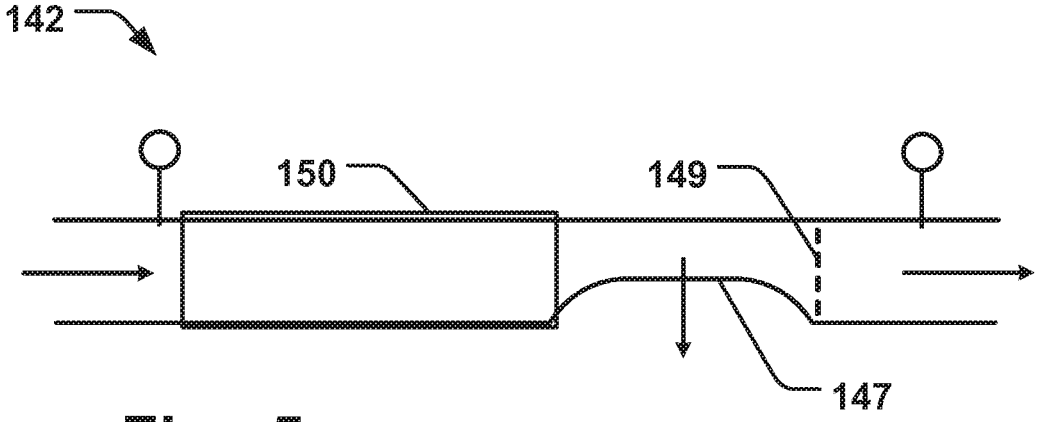
Figure 7A:
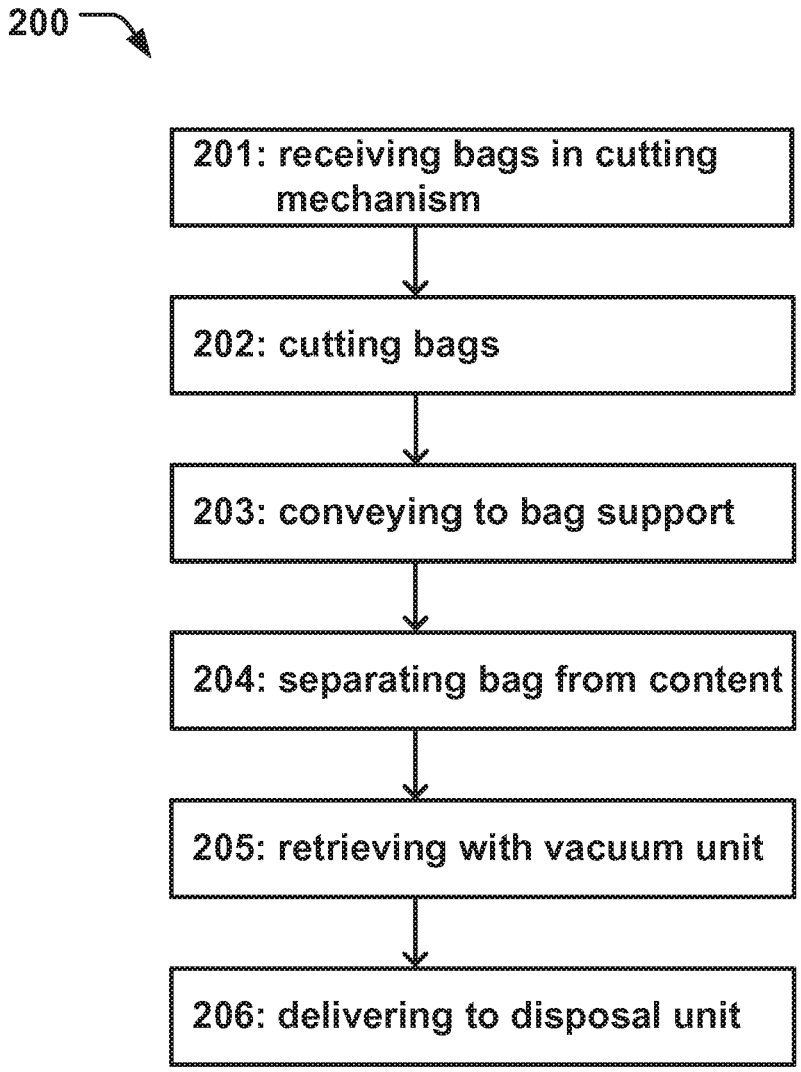
Figure 7B:
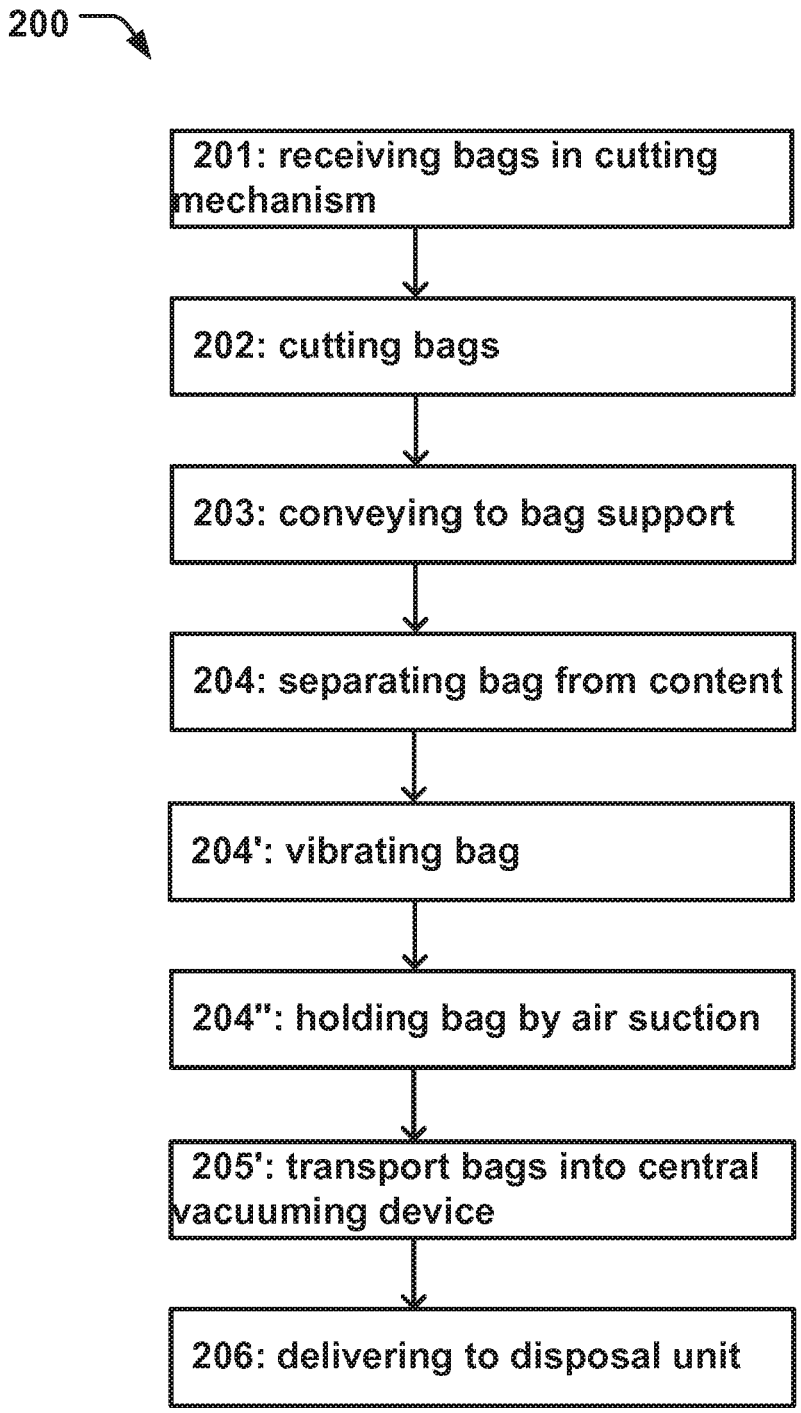

FIGS. 5*a-c* are schematic illustrations of a disposal unit of an apparatus for emptying bags, according to examples of the disclosure;

FIGS. 6*a-d* are schematic illustrations of a bag being cut in different cut directions in an apparatus for emptying bags to form a flap in the bag, according to examples of the disclosure;

FIG. 7*a* is a flowchart of a method for emptying bags according to examples of the disclosure; and FIG. 7*b* is a further flowchart of a method for emptying bags according to examples of the disclosure.

DETAILED DESCRIPTION

Specific examples of the invention will now be described with reference to the accompanying drawings. This invention may, however, be embodied in many different forms and should not be construed as limited to the examples set forth herein; rather, these examples are provided so that this disclosure will be thorough and complete, and will fully convey the scope of the invention to those skilled in the art. The terminology used in the detailed description of the examples illustrated in the accompanying drawings is not intended to be limiting of the invention. In the drawings, like numbers refer to like elements.

Figure 1:
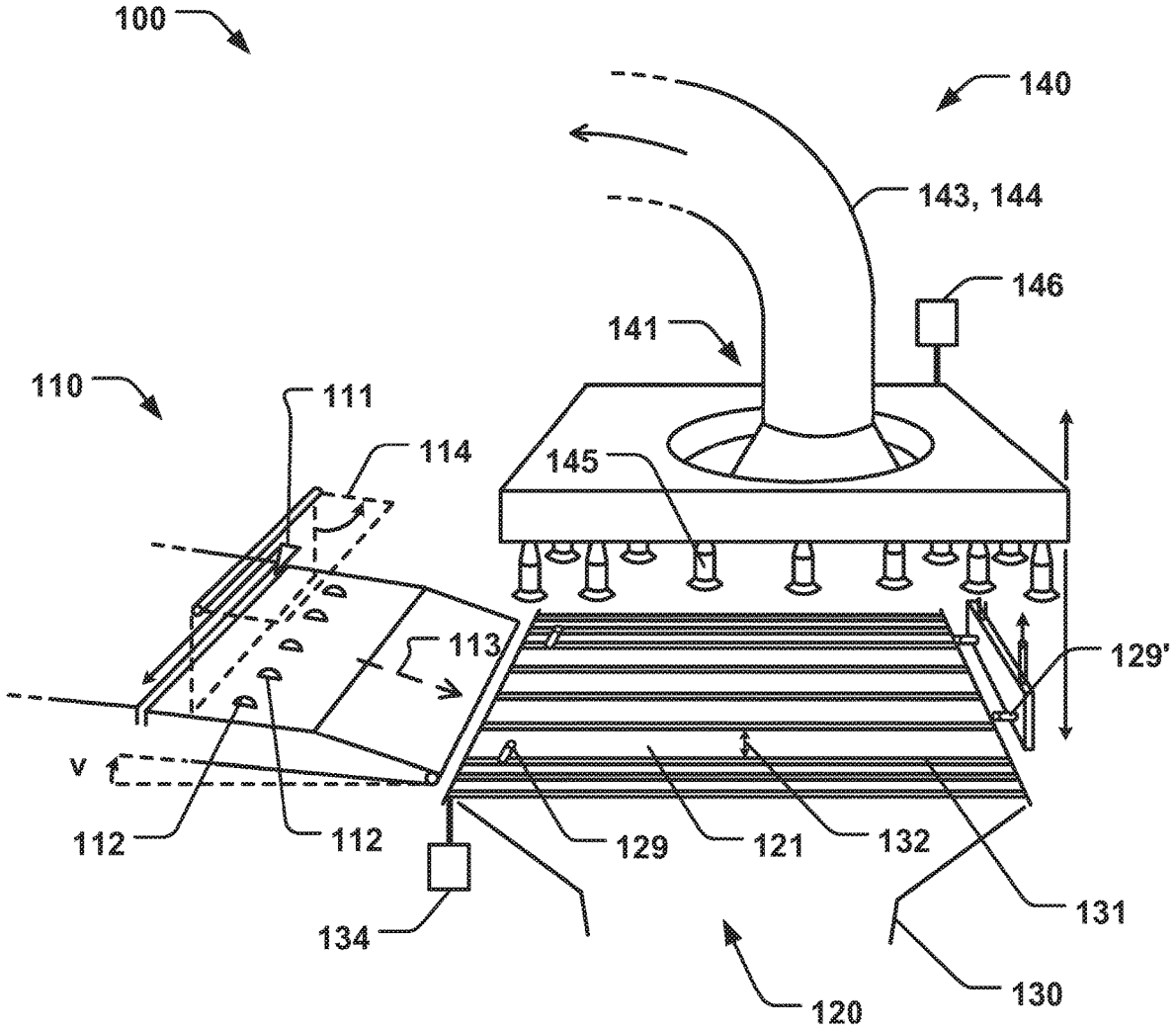
FIG. 1 is a schematic illustration of an apparatus for emptying bags, according to examples of the disclosure.

FIG. 1 is a schematic illustration of an apparatus 100 for emptying bags 300 (shown in FIGS. 6*a-d*). The apparatus 100 comprises a cutting mechanism 110 to cut the bags 300 and a bag support 120. The bag support 120 comprises a plurality of elongated support members 131 that extend in a longitudinal direction 113. When the apparatus 100 is operated, the bags 300 are received in the cutting mechanism 110 which cut the bags 300 and conveys the cut bags 300 to the bag support 120. The cutting mechanism 110 may comprise a cutting surface. The bags 300 may thus be placed on the cutting surface to be cut by the cutting mechanism 110, and further moved across the surface towards the bag support 120 where the bags 300 are placed. The cutting mechanism 110 may be arranged at the side of the bag support 120 as illustrated in FIG. 1 to facilitate the transfer of the cut bags 300 to the bag support 120. It is however conceivable that an intermediate conveyor (not shown) may be arranged between the cutting mechanism 110 and the bag support 120 for the transfer of the bags 300. It is also conceivable that the bags 300 may engage with the cutting mechanism 110 in other ways. The bags 300 may for example be suspended in a lift mechanism (not shown) which moves the bags 300 across the cutting mechanism 110 so that the bags 300 are cut, and further towards the bags support 120.

Figure 6A:
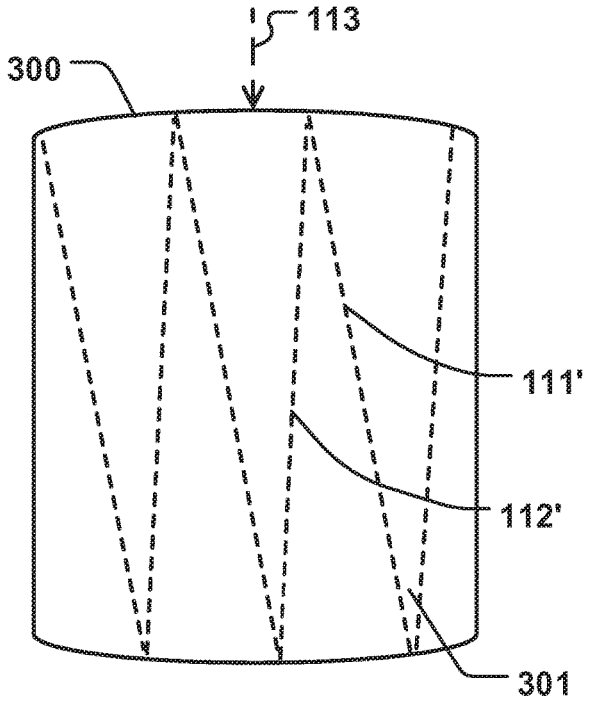
Figure 6B:
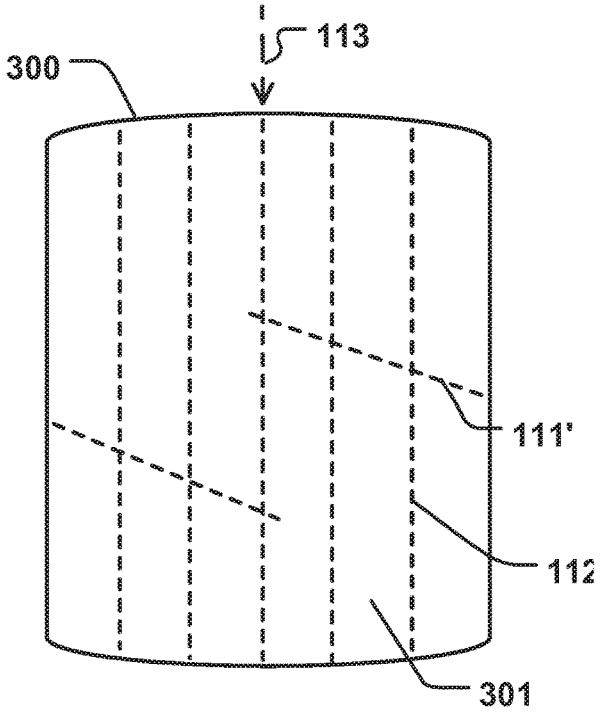
Figure 6C:
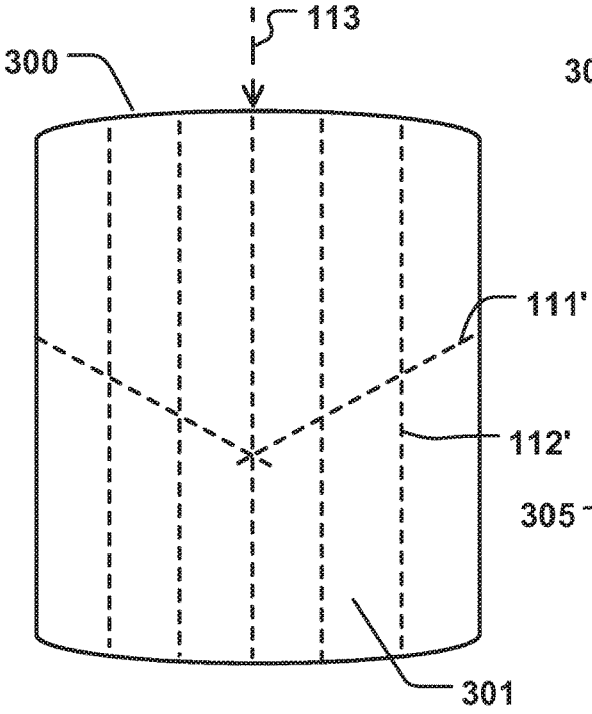
Figure 6D:
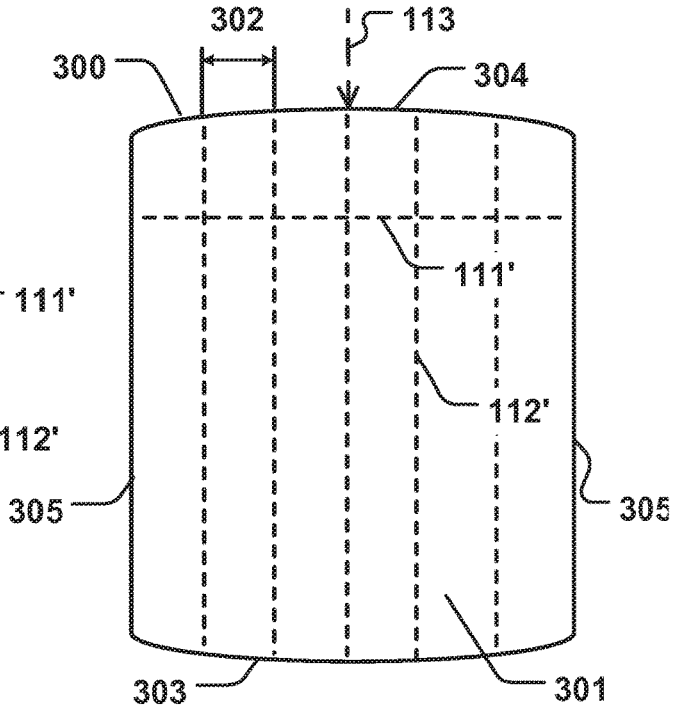

The cut bags 300 are separated from the contents therein on the bag support 120. The content is received in a collection unit 130 arranged beneath the bag support 120. The apparatus 100 comprises a bag disposal mechanism 140 comprising a vacuum unit 141 to retrieve bags 300 emptied on the bag support 120 and to deliver the bags 300 to a disposal unit 142. The disposal unit 142 is schematically illustrated in FIGS. 5*a-c* and will be described in more detail below. The cutting mechanism 110 comprises first and second cutting devices 111, 112. The first cutting device 111 is arranged to cut the bag 300 along a first cut direction 111' that is substantially transverse to said longitudinal direction 113. By substantially transverse means having an angle to the longitudinal direction 113 that is 90°±35°, or 90°±10° or even 90°. The second cutting device 112 is arranged to cut the bag 300 along a second cut direction 112' that is substantially parallel to said longitudinal direction 113. By substantially parallel means having an angle to the longitudinal direction 113 that is 0°±20°, or 0°±5°, or even 0°. Thus, the cutting mechanism 110 is arranged to cut the bags 300 along at least two cut directions 111', 112', in relation to the longitudinal direction 113, along which the bags 300 are conveyed from the cutting mechanism 110 to the bag support 120. By having the first and second cutting devices 111, 112, to cut along at least two cut directions 111', 112', a foldable flap 301 is cut in the material from which the bags 300 are formed so that the flap 301 can fold into openings 121 of the bag support 120 to empty the content through the openings 121. FIGS. 6*a-b* show examples of flaps 301 being cut in the bags 300 by the first and second cutting devices 111, 112. The flaps 301 are foldable due to being cut along at least two cut directions 111', 112', in relation to a longitudinal direction 113. Thus, as the flaps 301 have been cut in the cutting mechanism 110, and the bags 300 are placed onto the bag support 120, the openings 121 are dimensioned so that the flaps 301 will fold down into the openings 121, when the contents in the bags 301 put pressure on the flaps 301 under the influence of gravity. The material from which the bags 300 are formed can thus be quickly removed, as the plurality of flaps 301 folds into the bag support 120 through the openings 121, allowing for the contents to quickly escape the bags 300. FIGS. 6*a-b* show only examples of how the cut directions 111', 112', form different shapes of the foldable flaps 301, and it is conceivable that other variants in the shapes of the flaps 301 may also provide for an efficient emptying of the bags 300 through the openings 121. Folding of the flaps 301 through the openings 121 allows for a more efficient emptying of the bags 300, e.g. compared to techniques where the bags are just sliced along a single longitudinal cut, and thus also facilitating the high rate of material supply in some applications and process lines with a high throughput. The risk of leaving residues in the bags 300 is also minimized, and waste is reduced. The cutting of the bags 300 and the emptying as described is thus also fully automated, and no interference from an operator is required which allows for the highest hygienic standards to be fulfilled.

As shown in the examples of FIGS. 1 and 6*a-d*, the flaps 301 may be cut to be folded along the rear- or front ends 303, 304, of the bags 301, or generally along the peripheries (side ends) 305 of the bags 300. This provides for allowing the flaps 301 to fold along the corresponding sides of the bag support 120, when the cut bags 300 are placed thereon, through the openings 121. The material from which the bags 300 is formed may thus be moved to the sides for efficient and quick emptying of the contents while allowing the flaps 301 to remain attached to the remaining part of the bags 300.

Figure 3:
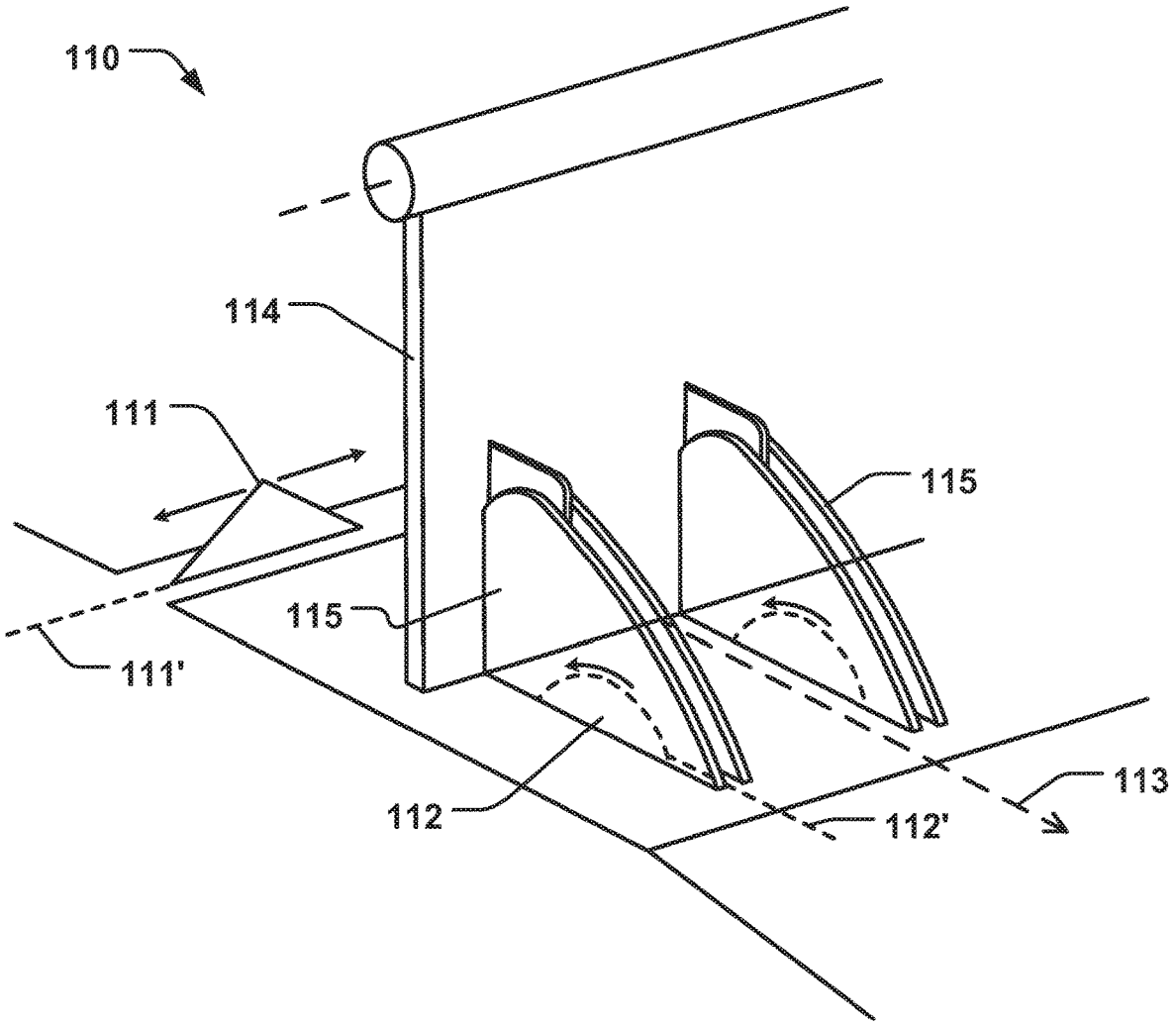
FIG. 3 is a schematic illustration of a cutting mechanism of an apparatus for emptying bags, according to examples of the disclosure.

In the examples shown in e.g. FIGS. 1 and 3, the first and second cutting devices 111, 112, are arranged to cut the side of the bags 300 which is placed on the bag support 120, i.e. the side underneath the bags 300. This may provide for a particularly advantageous arrangement of the foldable flaps 301 for an efficient emptying of the bags 300. It is conceivable however that at least one of the cutting devices 111, 112, may be arranged to cut the bags 300 on a side not necessarily to be arranged in contact with the bag support 120. For example, turning to FIG. 6*d*, the horizontal cut direction 112' may be placed at various positions between the rear- and front ends 303, 304, and even on a side defining the height of the bags 300 over the bag support 120, as long as a first (transverse) cut direction 111' is intersected by a second (longitudinal) cut direction 112' at the side to form a foldable flap 301. The second cut direction 112' may be parallel with the direction 113 along which the bags 300 are conveyed from the cutting mechanism 110 to the bag support 120.

The first and second cutting devices 111, 112, may be arranged to cut through the entire length and/or width of the bags 300, or at least the major part of said length and/or width, so that the flaps 301 become hinged at the peripheries 305, and/or at rear- or front ends 303, 304, of the bags 301. The flaps 301 may thus fold from the peripheries 305, and/or at rear- or front ends 303, 304, maximizing the resulting opening in the bags 301 through which the contents may escape. The risk of leaving residues in the bags 300 is thus also further minimized.

FIG. 1 shows one example of first and second cutting devices 111, 112. FIG. 3 is an enlarged view of a portion of the cutting devices 111, 112, in FIG. 1. In this example, the first cutting device 111 is shown as a transversally moving blade, and the second cutting device 112 is shown as a plurality of rotating blades. It should be understood that this is one variant of cutting devices 111, 112, arranged cut along at least two cut directions 111', 112'. A seen in FIGS. 6*a-d*, the cut directions 111', 112', and accordingly the placement of the first and second cutting devices 111, 112, may be varied to achieve varying patterns of flaps 301 in the bags 300 as illustrated. The cutting devices 111, 112, may comprise any device capable of piercing the material of the bags 300, such as by a rotating, transversally moving, or oscillating movement.

As schematically illustrated in FIGS. 1 and 3, the cutting mechanism 110 may comprise a gate 114 having a closed position in which the bags 300 are supported by the gate 114, and an open position in which the bags 300 can slide along the cutting mechanism 110 towards the bag support 120. The cutting mechanism 110 may be inclined by an angle (v) so that the bags 300 rest against the gate 114 in its closed position. As the gate 114 is opened the bags 300 can slide through the gate 114 and onto the bag support 120. In the closed position, the first cutting device 111 may be configured to cut the bags 300 in a first cut direction 111', and in the open position, the second cutting device 112 may be configured to cut the bags 300 in a second cut direction 112'. The bags 300 may thus be cut along first direction 111' while resting against gate 114, and subsequently be cut in the second cut direction 112' while sliding across second cutting device 112 as the gate 114 opens. Bags 300 are cut and conveyed to bag support 120 by controlling the position of the gate 114. This provides for an efficient and conveniently automated cutting mechanism 110.

The cutting mechanism 110 may be pivotable so that the bags 300 can be tipped onto the bag support 120 by a pivoting motion of the cutting mechanism 110 in relation to the bag support 120. Thus, the bags 300 may be guided and positioned at the cutting mechanism 110 at a first angle (v) before being further inclined with respect to the bag support 120, to facilitate the transfer of the bags 300 from the cutting mechanism 110 to the bag support 120. The gate 114 can remain closed while the angle (v) is increased, before being opened so that the bags 300 slide through the gate 114.

The cutting mechanism 110 may comprise a blade guard 115 arranged on the gate 114 to at least partly enclose the second cutting device 112 when in the closed position, as schematically illustrated in FIG. 3. The blade guard 115 may accordingly be lowered below the surface on which the bags 300 slide as the gate 114 opens.

Figure 2:
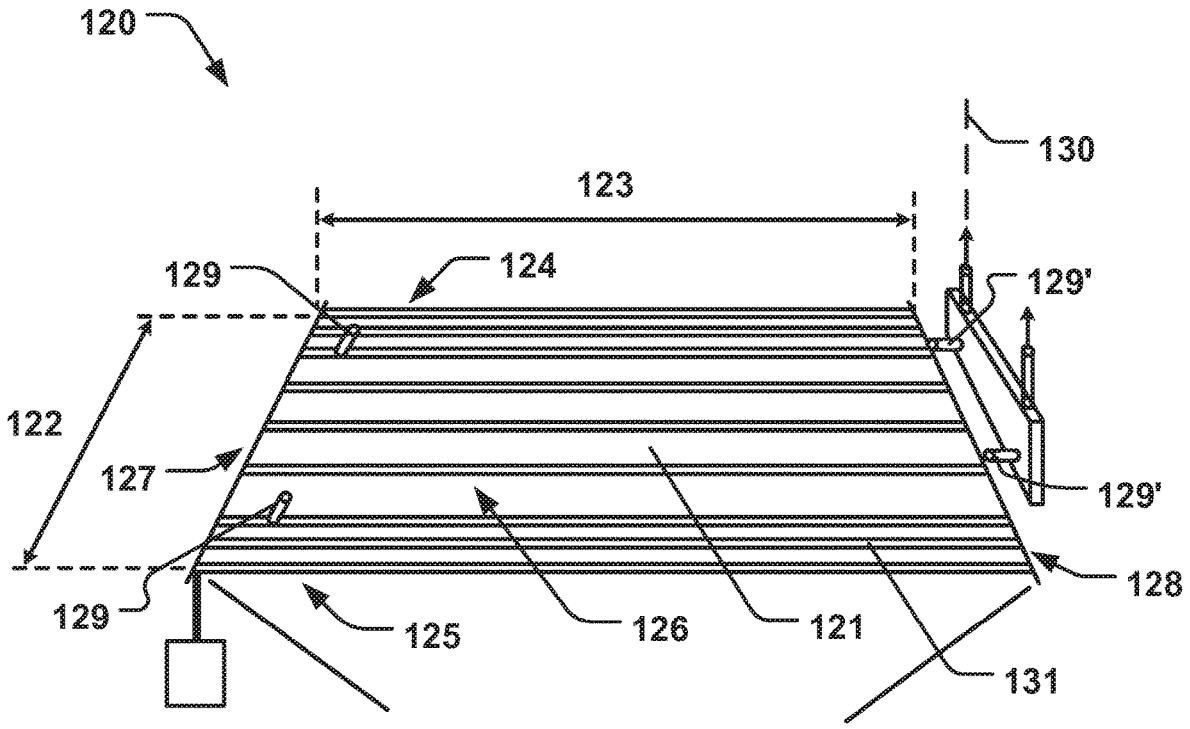
FIG. 2 is a schematic illustration of a bag support of an apparatus for emptying bags, according to examples of the disclosure.

The bag support 120 may have a width 122 transverse to the longitudinal direction 113, as schematically illustrated in FIG. 2. The width 122 extends between opposite peripheries 124, 125, of the bag support 120. The openings 121 in the bag support 120 may be smaller along the peripheries 124, 125, than in a center region 126 of the width 122. Thus, as illustrated in the example of FIG. 2, the openings 121 are larger close to the center region 126, than at the peripheries 124, 125, as seen in the transverse direction. The bag support 120 may thus have a larger surface area in contact with the bags 300 along the peripheries 124, 124, which provides for a better support at the peripheries 124, 124, facilitating the sliding of the bags 300 onto the bag support 120. At the same time, the larger openings at the center region 126 allows for the contents to be emptied more efficiently, since larger flaps 301 may fold down in the openings 121. The cutting mechanism 110 may be arranged so that flaps 301 are only cut in a portion of the bags 300 overlapping with the center region 126 of the bag support 120. It is also possible that the cutting mechanism 110, e.g. the distances between the blades of the second cutting device 112, may be arranged with varying spacing so that flaps 301 of different widths are cut, to be able to fold down into openings 121 of varying dimensions.

The bag support 120 may have a length 123 parallel to the longitudinal direction 113 extending between first and second sides 127, 128, of the bag support 120. The bag support 120 may comprise first retention units 129 arranged adjacent the first side 127 to engage with a rear end 303 of the bags 300 with respect the longitudinal direction 113 along which the bags 300 slide onto the bag support 120, as further illustrated in the example of FIG. 2. The first retention units 129 may thus engage with the rear end 303 of the bags 300 to facilitate achieving a correct positioning of the bags 300 on the bag support 120. E.g. as the bags 300 slide onto the bag support 120, the first retention units 129 may slow down the bags 300, e.g. by engaging into the cuts or by generally increasing the friction against the bags 300, and thereby prevent the bags 300 from sliding too far on the bag support 120. Also, the retention units 129 engage the rear of the opening that is cut in the bag 300, to thereby stop the sliding motion of the bag 300 over the bag support 120. The first retention units 129 may comprise a plurality of pins 129 arranged to extend upwards towards the bags 300 from the bag support 120, but may also comprise other structures arranged to grab onto the bags 300. By ensuring a correct positioning of the bags 300 on the bag support 120, the bags 300 can be stopped and emptied more efficiently, and be more accurately aligned with e.g. the bag disposal mechanism 140.

As mentioned, the bag support 120 may have a length 123 parallel to the longitudinal direction 113 extending between first and second sides 127, 128, of the bag support 120. The bag support 120 may comprise second retention units 129' arranged adjacent the second side 128 to engage with a front end 304 of the bags 300 with respect the longitudinal direction 113 along which the bags 300 slide onto the bag support 120, as illustrated in the example of FIG. 2. The second retention units 129' may be movable in a direction 130 out of a plane in which the bag support 120 extends, to lift the front end 304 of a bag 300 that is positioned on the bag support 120. Lifting the front end 304 of the bags 300 provides for further ensuring that the contents therein is emptied through the cut flaps 301 with a minimal amount of residues left in the bags 300. The second retention units 129' may comprise horizontally extending pins 129' as shown in FIG. 2, but may also comprise other structures arranged to lift the bags 300, such as hooks, spikes, ribs etc. The first and second retention units 129, 129', may be arranged in positions with respect to a mass center of the bags 300 so that the force provided by the first and second retention units 129, 129', can be evenly distributed, facilitating a symmetrical manipulation of the position of the bags 300 on the bag support 120. E.g. the first and second retention units 129, 129', may be symmetrically arranged with respect to a mass center of the bags 300.

The bag support 120 may comprise a plurality of elongated support members 131 that extend in a longitudinal direction 113. These support members may have the form of elongated bars 131 that are arranged to extend in the longitudinal direction 113, as schematically illustrated in FIGS. 1 and 2. The bars 131 may have a spacing 132 substantially corresponding to a width 302 of the foldable flap 301. The spacing 132 thus defines the size of openings 121 transverse to the longitudinal direction 113. The bags 300 may thus readily slide along the bars 131 into position on the bag support 120, and the flaps 301 can fold down between the spacing 132. The spacing 132 may be wider in a center region 126 of the plurality of bars 131 compared to the spacing between the bars 131 at the sides or peripheries 124, 125. This provides for improving the support for the bags 300 while allowing for an efficient emptying thereof, as discussed above. The bag support 120 may comprise other structures with openings 121 such as bars being bent or curved, or a grid with openings 121, or wires extending over the collection unit 130 etc. to support the bags 300.

The vacuum unit 141 may comprise a central vacuuming device 143 being movable in a direction towards the bag support 120 and being arranged to transport emptied bags 300 to the disposal unit 142 by air flow in a conduit 144. FIG. 1 shows an example of a central vacuuming device 143, in a perspective view, being movable in the vertical direction. Emptied bags 300 will be drawn into the central vacuuming device 143, due to the direction of vacuuming air flow into the conduit 144. The disposal unit 142 is arranged downstream from the conduit 144, and FIG. 5*a* shows an example of a disposal unit 142, through which the air flows as indicated with the arrows in the figure. The vacuuming device 143 thus provides for an efficient handling and disposal of the emptied bags 300, and thereby also for an improved fully automated procedure for emptying the bags 300.

Figure 4:
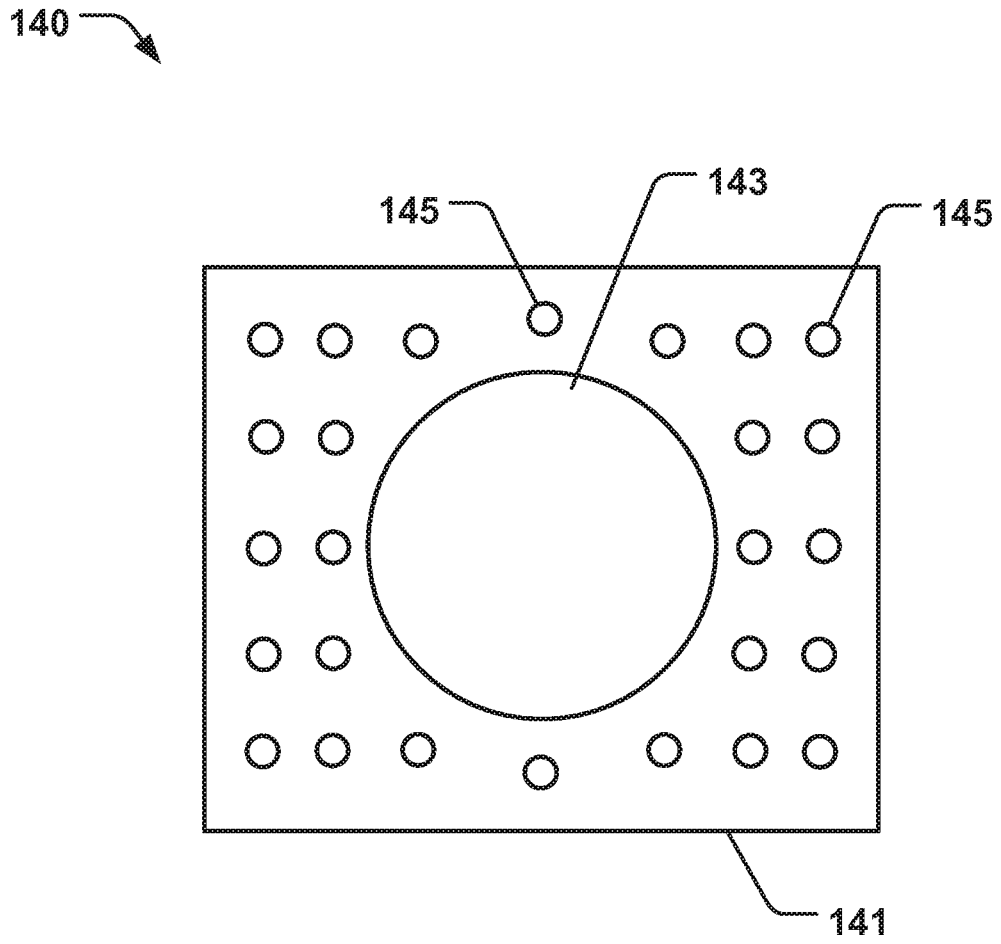
FIG. 4 is a schematic illustration of a vacuum unit of an apparatus for emptying bags, according to examples of the disclosure.

The vacuum unit 141 may comprise a plurality of suction devices 145 arranged around the central vacuuming device 143 to retrieve the bags 300 by air suction until the bags 300 are transported into the central vacuuming device 143. FIG. 4 is a schematic illustration of the central vacuuming device 143, in a view from the underneath of the vacuum unit 141, being surrounded by a plurality of suction devices 145. The plurality of suction devices 145 may move vertically with the vacuum unit 141 and engage with the emptied bags 300 on the bag support 120, whereupon the bags 300 are drawn to the suction devices 145 due to a vacuuming airflow into the suction devices 145. The plurality of suction devices 145 may then hold the bags 300 until any remaining content has been emptied, before the bags are drawn into the central vacuuming device 143. The air flow through the plurality of suction devices 145 may thus be cut off and overtaken by the airflow through the central vacuuming device 143 instead. Alternatively, the airflow through the central vacuuming device 143 is set to be sufficiently strong to overcome the retention force provided by the plurality of suction devices 145. While holding the bags 300, the suction devices 145 may be raised with the vacuum unit 141 in the vertical direction to lift the bags 300 from the bag support 120, which provides for facilitating the emptying thereof. Having the suction devices 145 arranged around the central vacuuming device 143 provides for retrieving the bags 300 with an evenly distributed force, so that the shape of the bags 300 can be maintained to allow the contents to readily escape, while the bags 300 may be collapsed with the airflow into the central vacuuming device 143 after being completely emptied. Content residues may thus be minimized while increasing the speed of the emptying and disposal of the bags 300. FIG. 4 shows one example of the distribution of the suction devices 145, and it should be understood that other arrangements are possible for optimization to various bag dimensions and materials while providing for the above mentioned advantages.

The bag support 120 and/or the vacuum unit 141 may be connected to a vibration device 134, 146, arranged to vibrate the bag support 120 and/or the vacuum unit 141. FIG. 1 shows a schematic vibration device 134 connected to the bag support 120, and a vibration device 146 connected to the vacuum unit 141. The bags 300 may thus be vibrated while placed on the bag support 120 and/or while being held by the vacuum unit 141, e.g. by the plurality of suction devices 145 described above. This further facilitates the emptying of the bags 300, and reduces contents wasted that otherwise may remain in the bags 300.

The disposal unit 142 may comprise an ejection port 147 being transferable to an open state in response to a sensor 148, 148', detecting a defined position of the bags 300. FIGS. 5*b-c* are schematic illustrations of a portion of the disposal unit shown in FIG. 5*a*. FIG. 5*b* shows an ejection port 147 in a closed state, and FIG. 5*c* shows the ejection port 147 in an open state. In this example, the disposal unit 142 comprises a movable cover 150 being arranged to move from a first position (FIG. 5*b*) where the ejection port 147 is covered, i.e. closed, to a second position (FIG. 5*c*) where the ejection port 147 is not covered, i.e. open. When a bag 300 is transported to the ejection port 147 from the vacuum unit 141, the sensor 148, 148', detects the bag 300 when it is located between the sensor 148, 148', and the ejection port 147 then moves to the open state to eject the bags 300 from the disposal unit 142 in response to a detection signal form the sensor 148, 148'. The disposal of the emptied bags 300 from the apparatus 100 may thus be facilitated, allowing for a fully automated handling which covers all steps of the procedure, from positioning and cutting the bags 300 until disposal thereof.

The sensor 148, 148', may comprise a pressure sensor 148, 148', connected to the disposal unit 142. Thus, the ejection port 147 may be transferable to the open state in response to a sensed pressure difference by a pressure sensor 148, 148'. Hence, as a bag 300 is transported to the ejection port from the vacuum unit 141, a pressure difference can be registered in the disposal unit 142, and the ejection port 147 moves to the open state to eject the bag 300. The sensor 148, 148', may comprise any other sensor such as optical or mechanical sensor arranged to detect the position of a bag 300.

The apparatus 100 may comprise a bag stop 149 arranged to position the bags 300 at a position in the disposal unit 142 overlapping with the ejection port 147, as schematically illustrated in FIGS. 5*b-c*. When the sensor 148, 148', detects a bag 300, the ejection port 147 transfers to the open state and air flow in the disposal unit 142 may be reduced so that the bags 300 positioned at the bag stop 149 may escape through the ejection port 147. This provides for further facilitating the disposal of the bags 300 from the apparatus 100.

A pump 151 may be arranged as schematically illustrated in FIG. 5*a* to provide the air flow in the bag disposal mechanism 140. A filter mechanism 152 may also be arranged between the pump 151 and the ejection port 147, to prevent any residues from being collected in the pump 151. The pump 151 may be run in reverse at desired intervals to remove any residues collected in the filter mechanism 152, e.g. via the ejection port 147.

FIG. 7*a* illustrates a flow chart of a method 200 for emptying bags 300. The order in which the steps of the method 200 are described and illustrated should not be construed as limiting and it is conceivable that the steps can be performed in varying order. The method 200 comprises receiving 201 the bags 300 in a cutting mechanism 110 to cut 202 the bags 300, conveying 203 the cut bags 300 to a bag support 120, separating 204 the bags 300 from the contents therein on the bag support 120, whereby the content is received in a collection unit 130 arranged beneath the bag support 120. The method comprises retrieving 205 the emptied bags 300 with a vacuum unit 141, and delivering 206 the bags 300 to a disposal unit 142. The bags 300 are cut along at least two different cut directions 111', 112', in relation to a longitudinal direction 113 along which the bags 300 are conveyed from the cutting mechanism 110, to thereby cut a foldable flap 301 in the material from which the bags 300 are formed. The flap 301 can then fold into openings 121 of the bag support 120 to empty the content through the openings 121. The method 200 thus provides for the advantageous benefits as described above for the apparatus 100 in relation to FIGS. 1-6.

FIG. 7*b* illustrates a further flow chart of a method 200 for emptying bags 300. The order in which the steps of the method 200 are described and illustrated should not be construed as limiting and it is conceivable that the steps can be performed in varying order. The method 200 may comprise vibrating 204' the bag support 120 and/or the vacuum unit 141 to empty the bags 300 into the collection unit 130, and holding 204" the bags 300 by air suction on the vacuum unit 141 until the bags 300 are transported 205' into a central vacuuming device 143 of the vacuum unit 141. A more efficient emptying of the bags 300 may thus be provided, as further discussed above with respect to the apparatus 100.

The method 200 may comprise activating a semi-automatic mode by deactivating the vacuum unit 141. The vacuum unit 141 may for example be mounted on a movable mechanism so that the vacuum unit 141 may be positioned out of the way from an operator. The bags 300 may then be pushed over the cutting mechanism 110, cutting the bags 300 along at least two cut directions 111', 112', as described above, and pushed further onto the bag support 120. The first and second cutting mechanisms 111, 112, may be activated by the operator, e.g. by a two-handed activation sequence, so that the gate 114 opens, and the bags 300 can be pushed or slide across the first second cutting mechanism 112. The apparatus 10 thus provides for a convenient and flexible mode of operation in a semi-automatic mode.

The present invention has been described above with reference to specific examples. However, other examples than the above described are equally possible within the scope of the invention. The different features and steps of the invention may be combined in other combinations than those described. The scope of the invention is only limited by the appended patent claims.

More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used.

The invention claimed is:

1. An apparatus for emptying bags, the apparatus comprising:

a cutting mechanism arranged to cut the bags;

a bag support comprising a plurality of elongated support members that extend in a longitudinal direction;

a collection unit arranged beneath the bag support, wherein the cutting mechanism is arranged to receive bags and to convey cut bags to the bag support, such that the cut bags are separated from the contents therein on the bag support, thereby allowing the content to be received in the collection unit; and a bag disposal mechanism comprising a vacuum unit arranged to retrieve bags emptied on the bag support and to deliver the emptied bags to a disposal unit, wherein the cutting mechanism comprises first and second cutting devices arranged to cut a bag along a first cut direction that is substantially transverse to said longitudinal direction, and along a second cut direction that is substantially parallel to said longitudinal direction, such that a flap is formed in the material from which the bag is made, thereby allowing the flap to fold into openings of the bag support to empty the content through the openings and into the collection unit, wherein the vacuum unit comprises a central vacuuming device being movable in a direction towards the bag support and being arranged to transport emptied bags to the disposal unit by air flow in a conduit, and wherein the vacuum unit comprises a plurality of suction devices arranged around the central vacuuming device to retrieve the bags by air suction until the bags are transported into the central vacuuming device.

2. The apparatus according to claim 1, wherein the cutting mechanism comprises a gate having a closed position in which the bags are supported by the gate, and an open position in which the bags can slide along the cutting mechanism towards the bag support, wherein, in the closed position, the first cutting device cuts the bags in the first cut direction, and wherein, in the open position, the second cutting device cuts the bags in the second cut direction.

3. The apparatus according to claim 1, wherein the cutting mechanism is pivotable so that the bags can be tipped onto the bag support by a pivoting motion of the cutting mechanism in relation to the bag support.

4. The apparatus according to claim 1, wherein the bag support has a width transverse to the longitudinal direction, the width extending between opposite peripheries of the bag support, and wherein the openings in the bag support are smaller along the peripheries than in a center region of the width.

5. The apparatus according to claim 1, wherein the bag support has a length parallel to the longitudinal direction extending between first and second sides of the bag support, wherein the bag support comprises first retention units arranged adjacent the first side to engage with a rear end of the bags with respect the longitudinal direction along which the bags slide onto the bag support.

6. The apparatus according to claim 1, wherein the bag support has a length parallel to the longitudinal direction which extends in a direction from a first side and a second side of the bag support, wherein the bag support comprises second retention units arranged adjacent the second side to engage with a front end of the bags with respect the longitudinal direction along which the bags slide onto the bag support, wherein the second retention units are movable in a direction out of a plane in which the bag support extends, to lift the front end of the bags.

7. The apparatus according to claim 1, wherein the elongated support members have the form of elongated bars that extend in the longitudinal direction and are spaced apart by a spacing.

8. The apparatus according to claim 1, wherein the bag support and/or the vacuum unit is connected to a vibration device arranged to vibrate the bag support and/or the vacuum unit.

9. The apparatus according to claim 1, wherein the disposal unit comprises an ejection port being transferable to an open state in response to a sensor detecting a defined position of the bags, whereby, when bags are transported to the ejection port from the vacuum unit, causing the sensor to detect the bags, the ejection port transfers to the open state to eject the bags from the disposal unit.

10. The apparatus according to claim 9, comprising a bag stop arranged to position the bags at a position in the disposal unit overlapping with the ejection port, wherein, when the sensor detects the bags, the ejection port transfers to the open state and air flow in the disposal unit is reduced so that the bags can escape through the ejection port.

11. A method for emptying bags, comprising:

receiving the bags in a cutting mechanism to cut the bags, conveying the cut bags to a bag support, separating the bags from the contents therein on the bag support, whereby the content is received in a collection unit arranged beneath the bag support, retrieving the emptied bags with a vacuum unit, delivering the bags to a disposal unit, wherein the bags are cut along at least two cut directions, in relation to a longitudinal direction along which the bags are conveyed from the cutting mechanism, to cut a foldable flap in the material from which the bags are formed so that the flap can fold into openings of the bag support to empty the content through the openings;

the method further comprising:

vibrating the bag support and/or the vacuum unit to empty the bags into the collection unit, and holding the bags by air suction on the vacuum unit until the bags are transported into a central vacuuming device of the vacuum unit.

12. The method according to claim 11, comprising:

activating a semi-automatic mode that comprises deactivating the vacuum unit and pushing the bags over the cutting mechanism to cut the bags and push the bags onto the bag support.

13. An apparatus for emptying bags, the apparatus comprising:

a cutting mechanism arranged to cut the bags;

a bag support comprising a plurality of elongated support members that extend in a longitudinal direction;

a collection unit arranged beneath the bag support, wherein the cutting mechanism is arranged to receive bags and to convey cut bags to the bag support, such that the cut bags are separated from the contents therein on the bag support, thereby allowing the content to be received in the collection unit; and a bag disposal mechanism comprising a vacuum unit arranged to retrieve bags emptied on the bag support and to deliver the emptied bags to a disposal unit, wherein the cutting mechanism comprises first and second cutting devices arranged to cut a bag along a first cut direction that is substantially transverse to said longitudinal direction, and along a second cut direction that is substantially parallel to said longitudinal direction, such that a flap is formed in the material from which the bag is made, thereby allowing the flap to fold into openings of the bag support to empty the content through the openings and into the collection unit, and wherein the cutting mechanism comprises a gate having a closed position in which the bags are supported by the gate, and an open position in which the bags can slide along the cutting mechanism towards the bag support, wherein, in the closed position, the first cutting device cuts the bags in the first cut direction, and wherein, in the open position, the second cutting device cuts the bags in the second cut direction.

14. The apparatus according to claim 13, wherein the vacuum unit comprises a central vacuuming device being movable in a direction towards the bag support and being arranged to transport emptied bags to the disposal unit by air flow in a conduit.

15. The apparatus according to claim 14, wherein the vacuum unit comprises a plurality of suction devices arranged around the central vacuuming device to retrieve the bags by air suction until the bags are transported into the central vacuuming device.

* * * * *